US006234484B1

(12) United States Patent
Strauss

(10) Patent No.: US 6,234,484 B1
(45) Date of Patent: May 22, 2001

(54) METHOD FOR A NOVEL CARD GAME

(76) Inventor: Paul Strauss, 600 W. 169th St., New York, NY (US) 10032-2910

( * ) Notice: Subject to any disclaimer, the term of this patent is extended or adjusted under 35 U.S.C. 154(b) by 0 days.

(21) Appl. No.: 09/350,446

(22) Filed: Jul. 9, 1999

(51) Int. Cl.[7] ..... A63F 1/00
(52) U.S. Cl. ..... 273/292; 273/303
(58) Field of Search ..... 273/292, 302, 273/303, 304, 305, 261, 260

(56) References Cited

U.S. PATENT DOCUMENTS 2,198,670 * 4/1940 Johnson .
4,489,948 * 12/1984 Keyser .
4,546,982 * 10/1985 Gaines .
5,106,100 * 4/1992 Yih .
5,711,526 * 1/1998 Van Hollebeke .
6,003,870 * 8/1998 Johnson .

* cited by examiner

*Primary Examiner*—Benjamin H. Layno
(74) *Attorney, Agent, or Firm*—Bierman, Muserlian and Lucas

(57) ABSTRACT

The novel card game employs a deck of cards with two or more suits and each suit having cards consecutively numbered starting from zero. The players select how many suits they will hold in, their hand and the number of cards from each suit. The cards are then dealt and each player, in order, places a card face up in the middle between the players. Each consecutive player then places a higher numbered card in the middle of the table until one player has no cards or until no cards can be played by any of the players. A winner is then declared based on the player who has no cards or the player with the lowest total value of face cards in his hand.

4 Claims, No Drawings

METHOD FOR A NOVEL CARD GAME

BACKGROUND OF THE INVENTION

1. Field of the Invention

This invention relates to a process for playing a card game played with a deck of cards having a plurality of suits each of which are consecutively numbered starting at zero. It is a game intended for small children to teach them mathematical skills.

2. Art Related to the Invention

All card games involve some mathematical skills, such as addition, number recognition, and reasoning. The use of mathematics should be taught to four and five-year olds but there are very few card games that can be played by young children. One card game that teaches counting and number recognition to young children using a conventional deck of cards is War. There is a need for more card games which work on improving mathematical skills of young children and which can be enjoyed by young and old alike.

SUMMARY OF THE INVENTION

A novel card game has now been discovered which is a pure strategy card game for two or more players. The card game of the invention is specifically intended for young card players, four to five-year olds, to teach them number recognition, counting with whole numbers, reasoning, addition, subtraction, multiplication and division. The card game of the invention provides enjoyment for young and old alike.

The card game of the invention employs a deck of cards with two or more suits, wherein each suit has cards consecutively numbered starting at zero.

The players pick the number of suits that each player will hold in their hand and the number of cards from each of the suits that they will hold.

Each player is then dealt a hand depending on the one chosen. Each player will have the number of suits chosen and the number of cards chosen. The cards in each suit will be consecutively numbered from zero.

The object of the game is to reach a certain predesignated total such as 20 or 50 points before any of your opponents do. If two or more players reach or surpass this total with the same score, then another game is played until one player has the highest score.

At the beginning of each game all cards are placed face up where each player has different suits which makes it easier to arrange the cards at the start of each game. One player is selected to start the first game. The players alternate in a clockwise direction for starting subsequent games. The first player plays any one of his cards face up to the middle of the table. Then going in a clockwise direction, the next player plays a higher card face up on top of the deck of cards thus far player. A card with 0 is both the highest card and the lowest card. But 0 is not greater than 0. If one cannot play a card, he passes to the next player.

Play continues until one of the following three possibilities:

(i) One player has played all his cards while the others still have cards left. He calls "Topit", and gets five points plus the total number of points still in everybody else's hands. For example, if one player has a 2 and a 4 left in his hand the total number of points is 6. The point total of 0 is, of course, 0.

(ii) No one has gone "Topit", and one or more players has a point total less than the others. The players with the lowest point total score the difference between their point totals and the total points the others have. For example, if four people are playing and two have only a 2 left in their hands while one of the others has a 3 and the other has a 2 and a 1, then the two players with only a 2 left score 4 points each.

(iii) No player can play, and each has the same point total in his hand. Then the one that played last gets one point.

Broadly, the invention is a process for playing a card game with two or more players (p) comprising:

(a) selecting a number of suits (m) and a number of cards per suit (n) to be dealt to each player;

(b) selecting a deck of cards that have p×m suits with consecutively numbered face cards in each suit, wherein the numbering starts at zero and continues to n−1;

(c) dealing each player a hand of cards based on the selection in (a) above;

(d) arranging the players in a circle;

(e) selecting a first player who then places a first card face up in the middle of the circle;

(f) rotating to another player who places another card on top of the card in the center of the circle, said other card being higher in number than the card in the center of the circle;

(g) repeating step (f) until no cards remain in one player's hand or until no player can place a card in the center of the circle; and (h) determining a win based on the player with no cards or on the players with face cards that add up to the lowest numerical total.

These and other aspects of the invention may be more fully understood by reference to the detailed description of the invention which has been chosen herein for purposes of illustration.

DESCRIPTION OF THE PREFERRED EMBODIMENT

The deck of cards used to play the game of the invention has two or more suits. Each suit is numbered starting at zero, a zero face card. The total number of suits in the deck can vary, however, it is preferred that the deck have four suits.

Suits can be distinguished by color of the numbers on the face of the cards, images in a corner or as a background or other design characteristic. For example, a barn animal like a horse, cow, duck or pig, can be used to distinguish one suit from another, i.e. a horse suit, cow suit, duck suit, and pig suit. Naturally, clubs, spades, diamonds and hearts could be used to distinguish one suit from another. Preferably, suits are distinguished from one another based on clubs, spades, diamonds and hearts.

The numbering of cards in each suit is identical. Each suit has a zero face card and are consecutively numbered from zero, i.e. 0, 1, 2, 3, 4, etc. Preferably, each suit has five face cards, numbered 0 through 4. It is essential that numbers are used on the face of the cards.

As will be appreciated, a conventional deck of cards can be used to play the game of the invention, provided two of the cards, say the King and Ace, are assigned the numbers 0 and 1.

The number of players in each game of the invention must be two or more. The only limitation to the number of players is the number of suits in the card deck. Multiple decks of cards can be used in order to allow for more players. For example, if each deck has four suits and eight players want to play, two decks can be combined to allow the eight players to play in one game.

At the beginning of the game, the players choose both the number of suits and the number of cards in each suit. As a short hand m×n is used to designate the game of the invention where m equals the number of suits and n equals the number of cards. Both m and n are positive whole numbers. For example, the players could choose 1×3 "Topit". In 1×3 "Topit", the players have chosen to play with one suit with three cards per suit. Each player will be dealt a 0, 1 and 2 face card in each suit, both players receiving a different suit. If the players had chosen 2×4 "Topit", each player would be dealt two different suits and each player would receive a 0, 1, 2 and 3 face card per suit, two 0 face cards, two 1 face cards, two 2 face cards and two 3 face cards.

As can be appreciated, in 1×2 and 2×2 for the game of the invention, the player that goes first will always lose. It is preferred that the game be played as 2×4 and, more preferably, 2×5.

In each case, the players receive at least one 0 face card. The 0 face card counts for 0 in scoring points, but when playing the game, it is either the lowest or the highest. The other face cards, 1, 2, etc., are assigned the value of the card as it appears on the face for both scoring and playing.

After choosing or selecting the number of suits and the number of cards, the players select the appropriate deck of cards (one have the proper number of suits) and deal the cards to each player accordingly.

Next, the players must choose whether they want to play open, closed, or clopen. Open mode is where each player arranges his cards face up in front of him so that each player sees the cards in the other players' hands. In closed mode, the cards are held in each player's hand so that the other players do not see the cards. It will be appreciated that each player receives the same hand, except for the suit, so that, at the start, each player will know the cards in the other player's hands. Clopen mode of the card game of the invention is played by having some cards face up, viewable for all players, and some cards held in the players' hands, not viewable by the other players. In clopen mode, the players choose how many cards to have face up (open) and how many to hold in their hand (closed).

The final choice of the players is which player shall start the game. Any conventional means can be employed to select the first player. For example, the player that pulls the highest cards from a deck of cards.

Once the first player has been selected, the players arrange themselves in a circle in a conventional manner and the selected first player places a card, face up, in the middle. The players then alternate in a clockwise direction placing a card on top of the card which is in the middle. Each player plays a higher face card than the one sitting face up in the middle. The face card 0 is treated as both the highest and the lowest, but a 0 face card cannot be played on another player's 0 face card. For example, if the face card in the middle is 0, the next player must place a 1, 2, 3, etc. on top of the 0 face card. If the face card in the middle is a 2, then the player can play a 0, 3, 4, 5, etc.

If a player does not have a card that can be played on top of the card in the middle, then the player skips his turn and plays no card.

As pointed out above, playing is continued until no more cards can be played and one of three scenarios occur, one player with no cards, one or more players with numbers lower than the other players, or all players have the same total points in their hands.

Scoring of points was detailed above for each of these three scenarios. The game is continued until one player reaches the predesignated (selected) total. As pointed out above, if two or more players surpass this number at the same time, another game is played to determine the highest (sudden death type situation).

The game of the invention can be played by each player individually, however, two players can form a partnership and combine their scores, in a manner similar to Bridge or other card games which are played with partners.

It will be understood that the claims are intended to cover all changes and modifications of the preferred embodiments of the invention herein chosen for the purpose of illustration which do not constitute a departure from the spirit and scope of the invention.

What is claimed is:

1. A process for playing a card game with two or more players (p) comprising:

(a) selecting a number of suits (m) a number of cards per suit (n) to be dealt to each player wherein the selection is made by the players;

(b) selecting a deck of cards that have p×m suits with consecutively numbered cards in each suit, wherein the numbering starts at zero and continues to n−1;

(c) dealing each player a hand of cards based on the selection in (a) above such that each of the players received cards according to the selection in (a) above and each of the players knows the cards in the other players hand;

(d) arranging the players in a circle;

(e) selecting a first player who then places a first card face up in the middle of the circle;

(f) rotating to another player who places a second card on top of the first card in the center of the circle, said second card being higher in number than the card in the center circle;

(g) repeating step (f) until no cards remain in one player's hand or until no player can place a higher numbered card in the center of the circle; and (h) determining a win based on the player with no cards in hand or on the players with cards in hand that add up to the lowest numerical total compared to the cards in hand of the other players.

2. The process of claim 1 wherein, after arranging the players in (d), the process further comprises each player placing his hand of cards face up in the circle so that each player can see the other players' hands.

3. The process of claim 2 wherein, after arranging the players in (d), the process further comprises each player holding his hand of cards so that no other player can see the cards in his hand.

4. The process of claim 2 wherein the deck of cards has four suits and each suit has cards consecutively numbered from 0 to 4.

* * * * *